United States Patent [19]

Jacobsen

[11] 4,278,099

[45] Jul. 14, 1981

[54] SMOKING DEVICE

[76] Inventor: Evan Jacobsen, 231 S. Lombard, Oak Park, Ill. 60302

[21] Appl. No.: 98,744

[22] Filed: Nov. 30, 1979

[51] Int. Cl.[3] ..... A24F 3/00; A24F 47/00

[52] U.S. Cl. ..... 131/178; 131/346

[58] Field of Search ..... 131/180, 178, 170 R, 131/171 R, 171 A, 194, 195, 263

[56] References Cited

U.S. PATENT DOCUMENTS

| | | | |
|---|---|---|---|
| 1,614,903 | 1/1927 | Shakal | 131/263 |
| 4,083,374 | 4/1978 | Jacobsen | 131/178 |

FOREIGN PATENT DOCUMENTS

| | | | |
|---|---|---|---|
| 713630 | 9/1966 | Italy | 131/263 |

*Primary Examiner*—Stephen C. Pellegrino

*Attorney, Agent, or Firm*—Alter and Weiss

[57] ABSTRACT

An improved smoking device comprising a container of smoking material, positioned juxtaposed to a viewing chamber that enables the observation of the trails of entrapped smoke and the determination of the amount of smoke in the viewing chamber. The smoke in the viewing chamber is forced into a smoke storage bag removed from the viewing chamber, when the smoker blows into a pipe stem. The blowing action mixes the smoke with the smoker's breath and provides an ideal smoke filled atmosphere in the bag which the smoker can then inhale.

11 Claims, 8 Drawing Figures

SMOKING DEVICE

This invention relates to smoking devices; and more particularly, to unique pipe-like smoking devices utilizing a smoke viewing chamber and a bag which the smoker fills with the smoke prior to inhaling.

Since man first started smoking, he has continuously been varying the smoking means and methods to enhance the enjoyment obtained by inhaling smoke, while attenuating the adverse effects of the harshness brought on by the heat and chemicals in the smoke.

The search for new methods of smoking, as well as new materials used in the smoking process, has been spurred on by the research that showed beyond doubt that smoking was a direct cause of cancer; and further, increased the possibility of suffering from cardio-vascular malfunctions.

An ever present problem encountered by smokers is the contention by non-smokers that the smokers are polluting the atmosphere. Non-smokers have been able to prevail upon the government and the people in charge of institutions and facilities available to the public to prevent people from smoking in the facilities. A well known example is the airlines wherein smoker's are restricted to certains areas of the plane; whereas, in other facilities, smokers are prohibited from smoking entirely. A major premise of that prohibition is the alleged contamination of the atmosphere. Also, there are many times when the smokers may not want others to know they have been smoking materials that leave characteristic odors.

Furthermore, when smokers merely inhale and exhale the smoke, much of the material in the smoke from which the smoker derives pleasure remains unused; and, in fact, wasted in the atmosphere. It is desirable to enable the smoker to maximize the use of the pleasurable materials in the smoke.

In the past, there have been provided smoking devices which enable the selective storage of the smoke. For example, in my own U.S. Pat. No. 4,083,374 which issued on Apr. 11, 1978, there is described smoking devices having control means for directing smoke selectively to the user, to a storage and blending bag, or to the atmosphere.

The smoking device described herein is an improvement over the smoking device described in my prior issued patent. In using the smoking device of that patent, the smoker first forced smoke into the smoke storage bag and then repeatedly inhaled and exhaled smoke to and from the storage bag. That smoking device used a valve arrangement which the smoker had to operate between inhaling and exhaling, to properly direct the smoke. Besides the operation of the valve, with my prior device. While it was possible to determine how much smoke was initially stored in the bag, a more accurate determination of the amount of smoke may sometimes be desired.

Further, the valve arrangements are relatively cumbersome and expensive.

Accordingly, an object of the present invention is to provide new and unique smoking devices.

It is a further object of the present invention to provide smoking devices which enable the smoker to observe the amount of smoke that will be stored in a storage container and then mix this smoke prior to the storage in the storage container—the mixture providing a density of smoke that enhances the pleasure of the user.

Another object of the present invention is to provide smoking devices wherein the smoker can first direct the smoke to a viewing chamber and then direct the smoke from the viewing chamber into a storage chamber; while mixing the smoke with more air.

A related object of the present invention is to provide the smoker with a fascinating view of the trails of the smoke as the smoke passes from the smoking material container into the viewing chamber.

A related object of the present invention is to provide smoking devices that automatically cool the smoke prior to the smoker's inhaling of the smoke.

Yet another object of the present invention is to enable the smoker to direct the smoke to a viewing compartment, a smoke container or to be inhaled by the smoker, using smoke directing means with no moving parts, rather than with valves used in prior art smoking devices.

Another object of the present invention is to provide smoking devices having unique tubular smoking material containers which facilitate lighting the smoking material and enabling the smoke to pass in random patterns into the viewing chamber. The random patterns are fascinating to watch.

A preferred embodiment of the present invention is a smoking device comprising a mouthpiece stem which leads past a smoking material bowl or container into an enclosed smoke viewing chamber. The viewing chamber is coupled to a smoke storage bag. An air hole is provided in the tube coupling the bag to the viewing chamber. By closing the air hole, it is possible to force the smoke from the smoke viewing chamber into the bag where it is cooled and stored. Subsequently, the smoker can inhale the smoke from the bag, again by closingthe air hole.

The smoking material container is cylindrical and fits into a conforming opening located in the smoking device, slightly above the juncture of the stem and the smoke viewing chamber. The tube coupling the bag to the smoke viewing chamber extends so that one side of the tube acts as a bulkhead forcing air coming from the stem into the smoke viewing chamber past the smoking material container.

To fill the smoke viewing chamber, air is inhaled through the stem past the smoking material bowl or container, while the air hole is blocked. The exposed side of the smoking material container is not covered by the smoker, when filling the smoke viewing chamber with smoke.

The above mentioned and other and further objects of the present invention will be best understood by making reference to the accompanying drawings, wherein.

Figure 1:
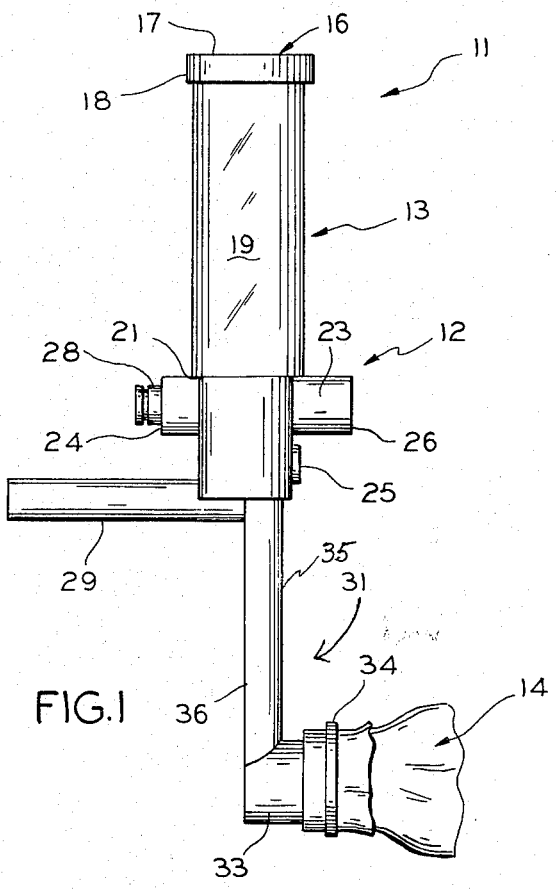
FIG. 1 is a side view of the smoking device.
Figure 2:
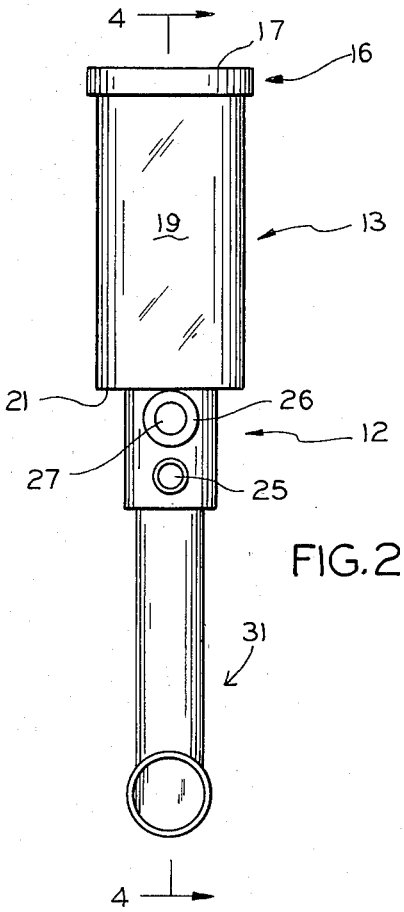
FIG. 2 is a rear view of the smoking device without the bag.

In FIG. 1 the smoking device 11 is shown as comprisinga smoking material container or a bowl retaining section 12, a compartment 13 for viewing and cooling the smoke and for measuring the amount of smoke, and means for further cooling, mixing and storing the smoke, such as bag 14. The compartment 13 is, in a preferred embodiment, an enclosed oval shaped transparent cylinder covered at the top thereof with means, such as cap 16. The cap 16 is also oval shaped having a horizontal section 17 with a peripheral, downwardly extending flange section 18 which press-fits over the vertical cylindrical walls 19 of the viewing compartment 13. The viewing compartment 13 terminates at a floor 21 and is integrally connected to the juxtaposed bowl retaining section 12.

In a preferred embodiment the container or bowl retaining section 12 is cylindrically shaped having a diameter slightly smaller than the minor diameter of the oval-shaped viewing compartment and having a longitudinal axis aligned with or parallel to longitudinal axis of the viewing chamber 13. The section 12 includes a container receiving cylinder 23 whose axis is transverse to the longitudinal axis of both the viewing chamber 13 and the cylindrical body 22 of the container holding section 12.

One end 24 of cylinder 23 is open. The other end has a closing bulkhead 26 with a built-in stopper 27 designed to extend into one end of the cylindrical smoking bowl or smoking material container 28, best seen in FIG. 5. A mouthpiece stem 29 is shown extending into the cylinder 22 at its juncture with a bag coupling tube 31.

Figures 4, 5, 6, 7, 8:
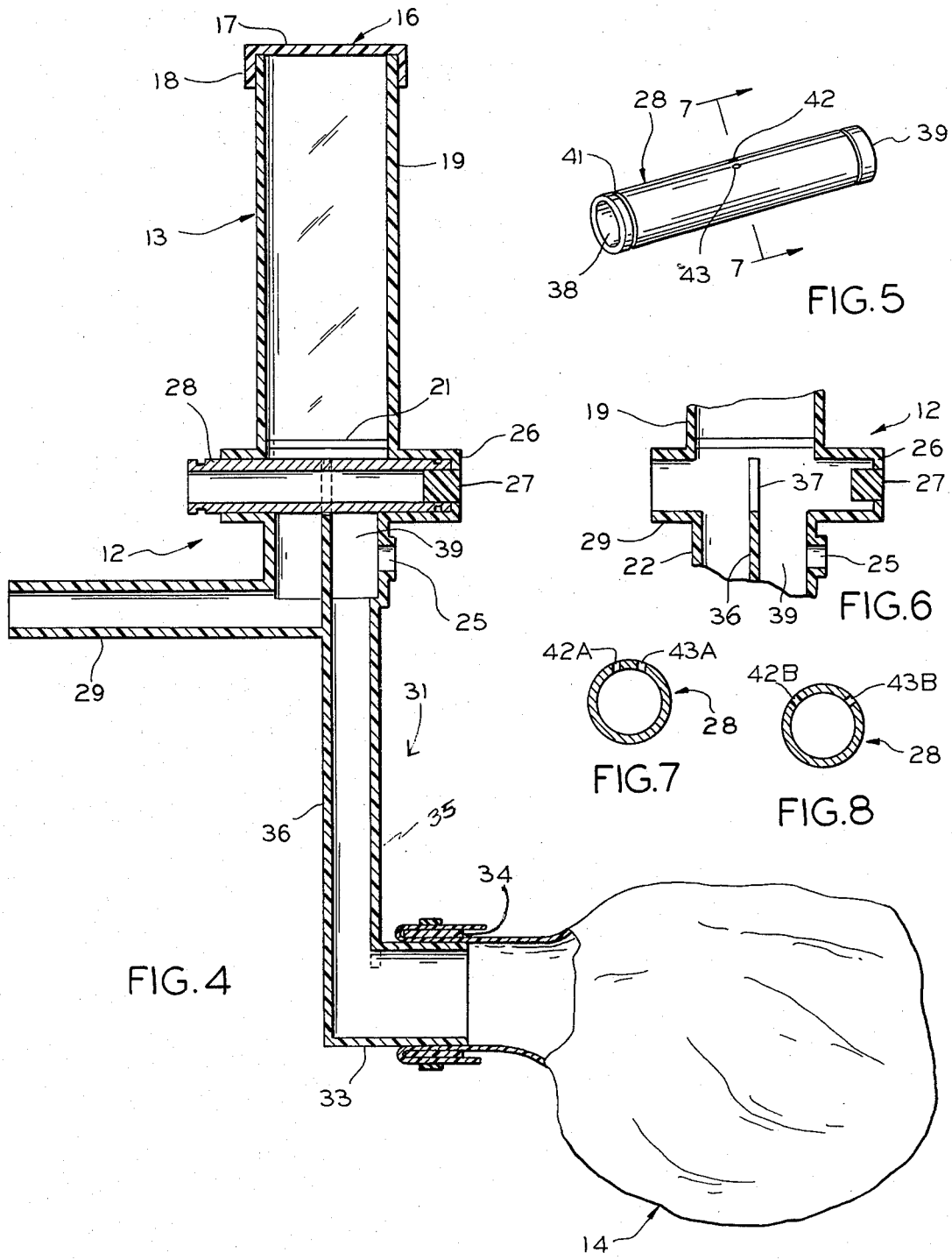
FIG. 4 is a sectional view of the smoking device of FIG. 2, taken on a plane along lines 4—4 and looking in the direction of the arrows.
FIG. 5 is a pictorial view of the smoking material bowl.
FIG. 6 is a sectional view showing details of the portion of the device used for retaining the bowl.
FIGS. 7 and 8 show cross sectional views of different embodiments of the smoking material bowl.

The coupling tube 31 is shown as having a vertical trough shaped tube 35 leading to a horizontal cylindrical section 33 to which the bag 14 is coupled by means, such as washer 34. As is best seen in FIG. 4, the flat wall 36 of the trough shaped tube 35 extends into cylinder 22 of bowl retaining section 12 effectively blocking off the mouthpiece stem 29 from direct contact with coupling tube 31. The top of the flat wall or bulkhead 36 has a U-shaped section 37 cut therein, best seen in FIG. 6, for receiving the smoking material container 28. Bulkhead 36, prevents a direct connection from the mouthpiece stem 29 to the bag 14 through tube 31. Instead, the connection from the mouthpiece 29 to the bag 14 must extend past smoking material container 28 into the viewing chamber 13 and then down through the interior portion 39 of tube 31 which extends into bowl retaining section 12. This portion where tube 31 and retaining section 12 overlap includes the air hole 25 which extends through the wall of cylinder 22 of the bowl retaining section 12.

The smoking material container 28 is shown as cylindrically shaped and having both ends 38 and 39 open. It preferably is made from any well known pipe material, such as meerschaum or walnut. It may, of course, be made from materials, such as aluminum.

Grooves are shown provided at each end, such as groove 41, to assist in removing the container 28 from the bowl retaining section 12.

Means, such as apertures 42 and 43, are provided for enabling the smoke of the burning smoking material to pass from the container 28 into the viewing chamber 13. FIGS. 7 and 8 show different embodiments of how the apertures may be placed to provide different trails of smoke in the viewing chamber. For example, in FIG. 7 a pair of parallel apertures 42A and 43A are shown spaced apart at the peripheral walls of the container 28. In FIG. 6 the apertures 42B and 43B are shown radially disposed in the walls of the container 28. Different variations of the apertures can be used within the scope of the invention.

The apertures 42 and 43 are shown longitudinally, centrally located on the cylinder of container 28. This enables the smoker to fill the container 28 with smoking material, place the container in the bowl retaining section and smoke the material until it reaches the point on the cylinder, where the apertures 42 and 43 are located. It has been found that the smoking material does not burn past the apertures. The smoker then removes the container 28; turns it around with the empty end towards the stopper 27; relights the smoking material at the end 39; and again smokes it down to the apertures. This enables smoking all of the smoking material in the container. It also keeps the viewing chamber clear of accumulated tars. When the apertures are further back, however, the front of the viewing chamber remains free of tars longer, enhancing the view.

Figure 3:
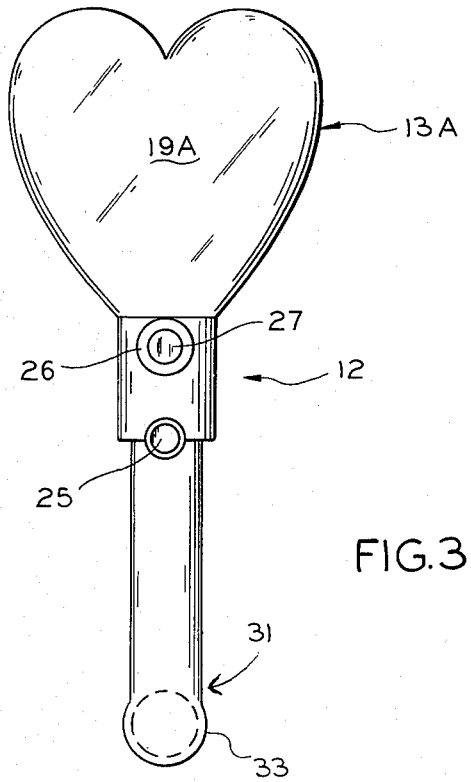
FIG. 3 is a rear view of another embodiment of the smoking device showing a differently shaped smoke viewing chamber.

In FIG. 3 the heart-shaped viewing chamber 13A is shown to emphasize the various shapes that the chamber can assume. With the changing shape of the chambers, the patterns of smoke trails vary differently. The smoke viewing chamber is ideally dimensioned to contain an amount of smoke that, when mixed with the breath of the smoker forced into the storage bag and then inhaled, provides the optimum smoking pleasure.

It should be recognized that the placement of the various components, such as the viewing chamber and the bag, can be varied within the scope of this invention, since the smoke is forced through the various stages; and therefore, does not rely fully on gravitational forces for moving the smoke through the different stages.

In operation the bowl container 28 is removed from the bowl retaining section 12 and placed with one open end against a flat surface, such as a table. The smoking material is placed into the cylindrical container 28 and the sides of the container are tapped to assure that the smoking material is evenly distributed within the container. Then preferably a pencil eraser is used to pack down the smoking material at the open surface. The tube is then turned over and more smoking material is placed on the other side; and also, packed down.

The container is then placed into retaining section 12 with the stopper 27 extending into container 28, as shown in FIG. 4. Care must be taken to assure that the apertures 42 and 43 are facing in the direction of viewing compartment13. Two fingers are used to direct the smoke as desired. One finger is selectively placed over the air hole 25 and the other finger (thumb) is selectively placed over the open end of container 28.

At this time the bag 14 should be completely collapsed. This is done by holding fingers over both the open end of container 28 and over the air hole 25 and inhaling.This completely collapses the bag. A lit match is then held at the open end of container 28. While the lit match is held in front of the container, the smoker inhales on the stem 29 covering the air hole 25. Smoke fumes from the apertures 42, 43 slowly curl into the smoke viewing chamber and create different and random designs.

The smoker continues to suck on the stem 29 until the viewing chamber becomes opaque or thick with smoke. As soon as there is sufficient smoke in the viewing chamber, the smoker covers both the open end of the container 28 and the air hole 25 and blows into the stem 29. This forces the smoke into the storage bag 14 mixed with the air used during exhaling. The mixed smoke in the bag is now properly cooled and of the right density so that when the smoker inhales, while again covering both the air hole 25 and the open end of the container 28, he receives an extremely gratifying and a satisfying mixture of smoke.

He again exhales the smoke sending it back to the bag. The smoke in the bag can be used and reused until it no longer satisfies the smoker; at which time, new smoke is generated and sent into the bag. If at any time there is still a wisp of smoke left in the viewing chamber, the smoker can inhale it by removing his finger from the air hole 25 and inhaling.

One embodiment of this smoking device includes a battery operated light for illuminating the viewing chamber.

The described smoking device enables the user to obtain a desired mixture of smoke and air at a temperature that maximizes the pleasure obtained from the smoke. At the same time, the smoker is entertained by the designs propogated as the smoke enters the viewing chamber.

While the principles of the invention have been described above in connection with specific apparatus and applications, it is to be understood that this description is made by way of example only and not as a limitation on the scope of the invention.

What is claimed is:

1. An improved smoking device comprising smoking material container receiving means, a viewing compartment juxtaposed to said smoking material container receiving means for receiving smoke from burning, smoking material within said smoking material container receiving means, stem means for directing air through said smoking material container receiving means to force smoke from said container to said viewing chamber, storage bag means for storing the smoke after viewing and prior to inhaling, and connecting means for connecting said viewing compartment to said storage bag means.

2. The improved smoking device of claim 1 including control means for causing said smoke to go either to said viewing compartment or said storage bag.

3. The improved smoking device of claim 2 wherein said control means comprises air hole means in said connecting means.

4. The improved smoking device of claim 1 wherein said connecting means comprises a hollow tubular member extending through said smoking material container to said viewing compartment, and said tubular-like member including means for attaching said storage bag means thereto.

5. The improved smoking device of claim 4 wherein said smoking material container receiving means comprises a detachable bowl, and means for retaining said detachable bowl.

6. The improved smoking device of claim 5 wherein said bowl is cylindrically shaped having an opening at each end thereof, and aperture means extending transverse to the longitudinal axis of said cylindrically shaped bowl for the passage of smoke therethrough.

7. The improved smoking device of claim 6 wherein said means for retaining said bowl includes means covering one of the open ends of said cylinder.

8. The improved smoking device of claim 7 wherein said stem means is connected to said connecting means only through a path that includes both said smoking material container receiving means and said viewing chamber compartment.

9. The improved smoking device of claim 1 wherein the viewing chamber comprises a cylinder substantially 16 cubic inches in volume.

10. An improved smoking device including smoking material container receiving means, a smoking material bowl fitting into said smoking material container receiving means, stem means for directing air through said smoking material container receiving means past said bowl, storage bag means coupled to said smoking material container receiving means and said viewing chamber for storing said smoke prior to inhaling, said improvement characterized in this that a viewing compartment is provided juxtaposed to said smoking material bowl enabling viewing trails of smoke arising from burning, smoking material in said bowl.

11. The improved smoking device of claim 10 further characterized in that said storage bag means is coupled to said stem means through said smoking material container receiving means and said viewing chamber, and air hole means in the path between said viewing chamber and said storage bag means for use in controlling the flow of smoke from said bowl to either said bag, said viewing chamber or the smoker.

* * * * *

UNITED STATES PATENT AND TRADEMARK OFFICE

CERTIFICATE OF CORRECTION

PATENT NO. : 4,278,099

DATED : July 14, 1981

INVENTOR(S) : Evan Jacobsen

It is certified that error appears in the above-identified patent and that said Letters Patent are hereby corrected as shown below:

Col. 2, line 35: Should be a space between "closing" and "the";

Col. 3, line 2: Should be a space between "comprising" and "a";

Col. 6, line 1: Insert --like-- after "tubular";

Col. 6, line 22: Delete "chamber".

Signed and Sealed this

*Twenty-fourth* Day of *November 1981*

[SEAL]

*Attest:*

GERALD J. MOSSINGHOFF

*Attesting Officer*

*Commissioner of Patents and Trademarks*